US009153427B2

(12) United States Patent
Goldberg et al.

(10) Patent No.: US 9,153,427 B2
(45) Date of Patent: Oct. 6, 2015

(54) VACUUM ULTRAVIOLET PHOTON SOURCE, IONIZATION APPARATUS, AND RELATED METHODS

(71) Applicant: Agilent Technologies, Inc., Loveland, CO (US)

(72) Inventors: Noah Goldberg, Loveland, CO (US); Gershon Perelman, Loveland, CO (US); Stuart C. Hansen, Loveland, CO (US)

(73) Assignee: Agilent Technologies, Inc., Santa Clara, CA (US)

( * ) Notice: Subject to any disclaimer, the term of this patent is extended or adjusted under 35 U.S.C. 154(b) by 66 days.

(21) Appl. No.: 13/796,292

(22) Filed: Mar. 12, 2013

(65) Prior Publication Data

US 2014/0167612 A1 Jun. 19, 2014

Related U.S. Application Data

(60) Provisional application No. 61/738,605, filed on Dec. 18, 2012.

(51) Int. Cl.

| | |
|---|---|
| ***H01J 17/26*** | (2012.01) |
| ***H01J 61/06*** | (2006.01) |
| ***H01J 61/52*** | (2006.01) |
| ***H05H 1/24*** | (2006.01) |
| ***H01J 65/04*** | (2006.01) |

(52) U.S. Cl.

CPC ..... *H01J 61/06* (2013.01); *H01J 61/526* (2013.01); *H01J 65/046* (2013.01); *H05H 1/2406* (2013.01)

(58) Field of Classification Search

CPC ..... H05H 1/2406; H05H 2001/2412

USPC ..... 315/111.01, 111.11, 111.21; 313/231.01, 231.31, 231.61

See application file for complete search history.

(56) References Cited

U.S. PATENT DOCUMENTS

| | | | | |
|---|---|---|---|---|
| 5,075,592 A | | 12/1991 | Seeboeck et al. | |
| 5,338,931 A | | 8/1994 | Spangler et al. | |
| 5,504,328 A | | 4/1996 | Bonser | |
| 5,666,026 A | * | 9/1997 | Matsuno et al. | 313/634 |
| 5,763,999 A | | 6/1998 | Matsumo et al. | |
| 5,955,840 A | | 9/1999 | Arnold et al. | |

(Continued)

FOREIGN PATENT DOCUMENTS

| | | |
|---|---|---|
| DE | 10042394 B4 | 4/2002 |
| JP | H07 220689 A | 8/1995 |

(Continued)

OTHER PUBLICATIONS

Chevrier, Dominique; International Search Report and Written Opinion mailed Feb. 12, 2014 for corresponding patent application PCT/US2013/069720, and references cited therein.

(Continued)

*Primary Examiner* — Thuy Vinh Tran

(57) ABSTRACT

A vacuum ultraviolet (VUV) photon source includes a body, a VUV window, electrodes disposed on the body outside an interior thereof, and a dielectric barrier between the electrodes. A method for generating VUV photons includes generating a dielectric barrier discharge (DBD) in an interior of a photon source by applying a periodic voltage between a first electrode and a second electrode separated by a dielectric barrier, wherein the DBD produces excimers from a gas in a gap between the electrodes, and transmitting VUV photons through a window of the photon source.

19 Claims, 7 Drawing Sheets

(56) References Cited

U.S. PATENT DOCUMENTS

| | | | | |
|---|---|---|---|---|
| 5,968,837 | A | 10/1999 | Doring et al. | |
| 6,373,192 | B1 * | 4/2002 | Morimoto et al. | 313/607 |
| 6,379,024 | B1 * | 4/2002 | Kogure et al. | 362/263 |
| 6,509,562 | B1 | 1/2003 | Yang et al. | |
| 6,525,451 | B1 | 2/2003 | Hishinuma et al. | |
| 6,614,185 | B1 | 9/2003 | Nishimura et al. | |
| 6,633,109 | B2 | 10/2003 | Falkenstein | |
| 6,646,256 | B2 | 11/2003 | Gourley et al. | |
| 6,741,036 | B1 | 5/2004 | Ikedo et al. | |
| 6,835,929 | B2 | 12/2004 | Finch | |
| 7,304,298 | B2 | 12/2007 | Swenson et al. | |
| 7,382,087 | B2 * | 6/2008 | Tabata et al. | 313/362.1 |
| 7,550,911 | B2 | 6/2009 | Terada et al. | |
| 7,582,863 | B2 | 9/2009 | Picard et al. | |
| 7,642,510 | B2 | 1/2010 | McEwen | |
| 7,687,997 | B2 | 3/2010 | Gaertner et al. | |
| 7,714,511 | B2 | 5/2010 | Mizojiri et al. | |
| 7,977,629 | B2 | 7/2011 | McEwen et al. | |
| 7,978,964 | B2 | 7/2011 | Ranish et al. | |
| 7,997,949 | B2 | 8/2011 | Minamoto et al. | |
| 8,071,043 | B2 | 12/2011 | Como et al. | |
| 8,080,783 | B2 | 12/2011 | Whitehouse et al. | |
| 8,106,588 | B2 | 1/2012 | Braun et al. | |
| 8,237,364 | B2 | 8/2012 | Hombach et al. | |
| 2004/0144733 | A1 * | 7/2004 | Cooper et al. | 210/748 |
| 2005/0236997 | A1 | 10/2005 | Danner et al. | |
| 2010/0032599 | A1 | 2/2010 | Herges et al. | |
| 2011/0056513 | A1 | 3/2011 | Hombach et al. | |
| 2011/0297844 | A1 | 12/2011 | Vecziedins et al. | |

FOREIGN PATENT DOCUMENTS

| | | | |
|---|---|---|---|
| JP | H08 236084 | A | 9/1996 |
| JP | H09 274893 | A | 10/1997 |
| JP | 2004 265770 | A | 9/2004 |
| WO | 2006060130 | A2 | 6/2006 |
| WO | 2007014019 | A2 | 1/2007 |

OTHER PUBLICATIONS

Kogelschatz, Ulrich; Dielectric-barrier Discharges: Their History, Discharge Physics, and Industrial Applications; Plasma Chemistry and Plasma Processing; vol. 23, No. 1; Mar. 2003.

Bletzinger, et al.; Large-area Atomospheric Pressure Dielectric Discharge using a High-Power Plasma Switch; Source: Collection of Technical Papers—44th AIAA Aerospace Sciences Meeting; v 23, p. 17530-17537, 2006; ISBN-10: 1563478072, ISBN-13: 9781563478079 Jan. 9, 2006-Jan. 12, 2006; Publisher: Abstract only.

Tsvetkov, V.M.; The Various Dielectric Barrier Discharges Lamps and Plasma Panel Prototype Designs Developed in VNIIEF; Proceedings of SPIE—The International Society for Optical Engineering. v 6938, 2008, Atomic and Molecular Pulsed Lasers VII; ISSN: 0277786X; ISSN-13: 9780819471253; DOI: 10.1117/12.785669; Article No. 693811; 8th International Conference Atomonic and Molecular Pulsed Lasers, AMPL-2007, Sep. 10, 2007-Sep. 14, 2007; Abstract only.

Sobottka, et al.; An Open Argon Dielectric Barrier Discharge VUV-Source; Source: Plasma Processes and Polymers, v 7, n 8, p. 650-656, Aug. 23, 2010; ISSN: 16128850; E-ISSN: 16128869; DOI: 10.1002/ppap.200900145; Publisher: Wiley-VCH Verlag; Abstract only.

Masoud, et al.; Vacuum Ultraviolet Emissions from a Cylindrical Dielectric Barrier Discharge in Neon and Neon-Hydrogen Mixtures; Source: International Journal of Mass Spectrometry, v 233, n. 1-3, 395-403, Apr. 15, 2004; ISSN: 1387-3806; DOI: 10.1016/j.ijms.2004.02.007; Publisher: Elsevier, Netherlands; Abstract Only.

* cited by examiner

VACUUM ULTRAVIOLET PHOTON SOURCE, IONIZATION APPARATUS, AND RELATED METHODS

RELATED APPLICATIONS

This application claims the benefit of U.S. Provisional Patent Application Ser. No. 61/738,605, filed Dec. 18, 2012, titled "VACUUM ULTRAVIOLET PHOTON SOURCE, IONIZATION APPARATUS, AND RELATED METHODS," the content of which is incorporated by reference herein in its entirety.

TECHNICAL FIELD

The present invention relates generally to generating vacuum ultraviolet (VUV) photons, which may be utilized, for example, for photo-ionization of neutral molecules. Photo-ionization may be implemented, for example, in conjunction with mass spectrometry (MS).

BACKGROUND

A mass spectrometry (MS) system in general includes an ionization apparatus (or ion source) for ionizing components of a sample of interest, a mass analyzer for separating the ions based on their differing mass-to-charge ratios (or m/z ratios, or more simply "masses"), an ion detector for counting the separated ions, and electronics for processing output signals from the ion detector as needed to produce a user-interpretable mass spectrum. Typically, the mass spectrum is a series of peaks indicative of the relative abundances of detected ions as a function of their m/z ratios. The mass spectrum may be utilized to determine the molecular structures of components of the sample, thereby enabling the sample to be qualitatively and quantitatively characterized. In certain "hyphenated" or "hybrid" systems, the sample supplied to the ionization apparatus may first be subjected to a form of analytical separation. For example, in a liquid chromatography-mass spectrometry (LC-MS) system or a gas chromatography-mass spectrometry (GC-MS) system, the output of the LC or GC column may be transferred into the ion source through appropriate interface hardware.

The type of ionization apparatus deployed in the system depends on many factors. Examples of ionization techniques implemented by different types of ionization apparatuses include photo-ionization (PI), electrospray ionization (ESI), chemical ionization (CI), field ionization (FI), electron ionization (EI), laser desorption ionization (LDI), and matrix-assisted laser desorption ionization (MALDI). Some of these techniques are effective at or near atmospheric pressure and others are effective at vacuum pressure, while some may be adapted for implementation in either regime.

Ultraviolet (UV) PI is becoming recognized for its ability to ionize many chemical species, both polar and non-polar, with reduced ion suppression and retention of high sensitivity and dynamic range, as compared for example to widely used ESI. With the appropriate choice of photon wavelength (energy), efficient analyte ionization and low levels of undesired ionization of common LC solvents can be achieved simultaneously. Common UV PI sources, however, use a low internal-pressure gas discharge lamp, e.g. krypton (10.2 eV), in an atmospheric pressure ionization chamber. These sources are limited in their use mainly by low-intensity radiation (photon flux), ambient optical absorption of the UV flux, and unwanted ion chemistry in the high-pressure environment.

Therefore, there is a need for PI sources capable of producing higher photon flux levels and ionization efficiency with minimal ionization of non-analytical molecules, and which are effective for providing the advantages of UV PI in both low-pressure and high-pressure environments.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one embodiment, a vacuum ultraviolet (VUV) photon source includes: a body enclosing an interior and comprising a VUV window; a first electrode disposed on the body outside the interior; a dielectric barrier; and a second electrode disposed on the dielectric barrier outside the interior, and separated from the first electrode by a gap in the interior, wherein the dielectric barrier is disposed between the first electrode and the second electrode.

According to another embodiment, a photo-ionization (PI) apparatus includes: a chamber comprising a sample inlet and an ion outlet; and a VUV photon source disposed in the chamber.

According to another embodiment, a mass spectrometry (MS) system includes: a PI apparatus; and a mass analyzer communicating with the PI apparatus.

According to another embodiment, a method for generating vacuum ultraviolet (VUV) photons includes: generating a dielectric barrier discharge (DBD) in an interior of a photon source by applying a periodic voltage between a first electrode and a second electrode, wherein the first electrode and the second electrode are disposed outside the interior and are separated by a dielectric barrier and a gap in the interior, and wherein the DBD produces excimers from a gas in the gap; and transmitting VUV photons emitted from the excimers through a window of the photon source.

According to another embodiment, a method for ionizing a sample includes: introducing the sample into a chamber; and exposing the sample to VUV photons by generating the VUV photons according to any of the methods disclosed herein, wherein the VUV photons are transmitted into the chamber from the window.

According to another embodiment, a method for analyzing a sample includes: ionizing the sample according to any of the methods disclosed herein to produce ions; and transmitting the ions into a mass analyzer.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
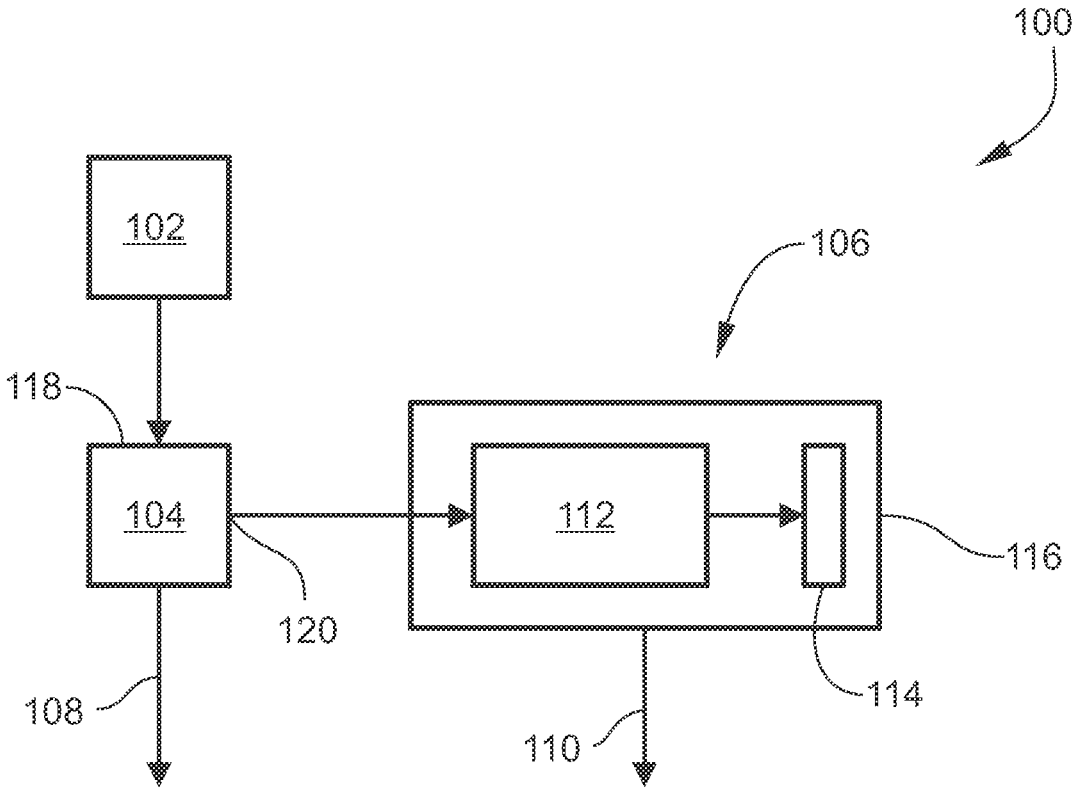
FIG. 1 is a schematic view of an example of a mass spectrometry (MS) system according to one embodiment.

FIG. 1 is a schematic view of an example of a mass spectrometry (MS) system 100 according to one embodiment. The MS system 100 generally includes a sample source 102, an ionization apparatus (or ion source) 104, a mass spectrometer (MS) 106, and a vacuum system for maintaining the interior of the MS 106 (and in some embodiments the interior of the ionization apparatus 104) at controlled, sub-atmospheric pressure levels. The vacuum system is schematically depicted by vacuum lines 108 and 110 leading from the ionization apparatus 104 and MS 106, respectively. The vacuum lines 108 and 110 are schematically representative of one or more vacuum-generating pumps and associated plumbing and other components appreciated by persons skilled in the art. The structure and operation of various types of sample sources, ionization apparatuses, MSs, and associated components are generally understood by persons skilled in the art, and thus will be described only briefly as necessary for understanding the presently disclosed subject matter. In practice, the ionization apparatus 104 may be integrated with the MS 106 or otherwise considered as the front end or inlet of the MS 106, and thus in some embodiments may be considered as a component of the MS 106.

The sample source 102 may be any device or system for supplying a sample to be analyzed to the ionization apparatus 104. The sample may be provided in a liquid- or gas-phase form that flows from the sample source 102 into the ionization apparatus 104, or in a solid form in which case the sample source 102 may be a sample support structure or sample probe that is loaded into or mounted in the ionization apparatus 104. In hyphenated systems such as liquid chromatography-mass spectrometry (LC-MS) or gas chromatography-mass spectrometry (GC-MS) systems, the sample source 102 may be an LC or GC system, in which case an analytical column of the LC or GC system is interfaced with the ionization apparatus 104 through suitable hardware. The pressure in the sample source 102 (or the pressure outside the outer structure of the ionization apparatus 104) is typically around atmospheric pressure (around 760 Torr) or at a somewhat sub-atmospheric pressure.

Generally, the ionization apparatus 104 is configured for producing analyte ions from a sample provided by the sample source 102 and directing the as-produced ions into the MS 106. In embodiments described herein, the ionization apparatus 104 is a photo-ionization (PI) apparatus (or PI source). The ionization apparatus 104 may generally include an ionization chamber that receives or supports the sample, and a PI device configured for generating photons that irradiate the sample to effect ionization. In embodiments described herein the PI device is a vacuum ultraviolet (VUV) photon source (or VUV photon lamp), as described further below by way of examples. For purposes of the present disclosure, the wavelength at which VUV photons propagate is generally taken to be 200 nm or lower. The internal pressure of the ionization apparatus 104 may generally range from 0 to 1000 Torr. Thus, in some embodiments the ionization apparatus 104 may be utilized for atmospheric pressure photo-ionization (APPI). In other embodiments, the internal pressure of the ionization apparatus 104 is maintained by the vacuum system at an intermediate, sub-atmospheric pressure that is lower than the pressure of the sample source 102 (or the ambient pressure outside the ionization apparatus 104) but is higher than the vacuum pressure inside the MS 106, particularly the mass analyzing region of the MS 106. In some embodiments, the pressure of the ionization apparatus 104 ranges from 0.01 to 100 Torr. In other embodiments, the pressure of the ionization apparatus 104 ranges from 0.05 to 50 Torr. In other embodiments, the pressure of the ionization apparatus 104 ranges from 0.1 to 10 Torr.

The MS 106 may generally include a mass analyzer 112 and an ion detector 114 enclosed in a housing 116. The vacuum line 110 maintains the interior of the mass analyzer 112 at very low (vacuum) pressure. In some embodiments, the mass analyzer 112 pressure ranges from $10^{-4}$ to $10^{-9}$ Torr. The vacuum line 110 may also remove any residual non-analytical neutral molecules from the MS 106. The mass analyzer 112 may be any device configured for separating, sorting or filtering analyte ions on the basis of their respective m/z ratios. Examples of mass analyzers include, but are not limited to, multipole electrode structures (e.g., quadrupole mass filters, ion traps, etc.), time-of-flight (TOF) analyzers, and ion cyclotron resonance (ICR) traps. The mass analyzer 112 may include a system of more than one mass analyzer, particularly when ion fragmentation analysis is desired. As examples, the mass analyzer 112 may be a tandem MS or $MS^n$ system, as appreciated by persons skilled in the art. As another example, the mass analyzer 112 may include a mass filter followed by a collision cell, which in turn is followed by a mass filter (e.g., a triple-quad or QQQ system) or a TOF device (e.g., a qTOF system). In other embodiments another type of analytical separation instrument, such as an ion mobility spectrometer (IMS), may be substituted for the MS 106 (in which case an IMS drift tube may be substituted for the mass analyzer 112) or operate in tandem with the MS 106 to provide an additional dimension to the analysis. The ion detector 114 may be any device configured for collecting and measuring the flux (or current) of mass-discriminated ions outputted from the mass analyzer 112. Examples of ion detectors 114 include, but are not limited to, electron multipliers, photomultipliers, and Faraday cups.

FIG. 1 schematically depicts the ionization apparatus 104 as including a sample inlet 118 for introducing a sample into the ionization apparatus 104 and an ion outlet 120 for transferring an ion beam into the MS 106. The sample inlet 118 may be a conduit for introducing a fluid sample, or a sealable door for introducing a solid sample. The ion outlet 120 may be any component or combination of components configured for enabling the analyte ions to be transferred into the mass analyzer 112 with minimal or no loss of ions, with minimal non-analytical components such as neutral species, and without breaking the vacuum of the MS 106. The ion outlet 120 may, for example, include one or more of the following, as appreciated by persons skilled in the art: capillary, orifice, ion optics, skimmer plate, ion guide, ion funnel, ion slicer, aperture, etc.

Figure 2:
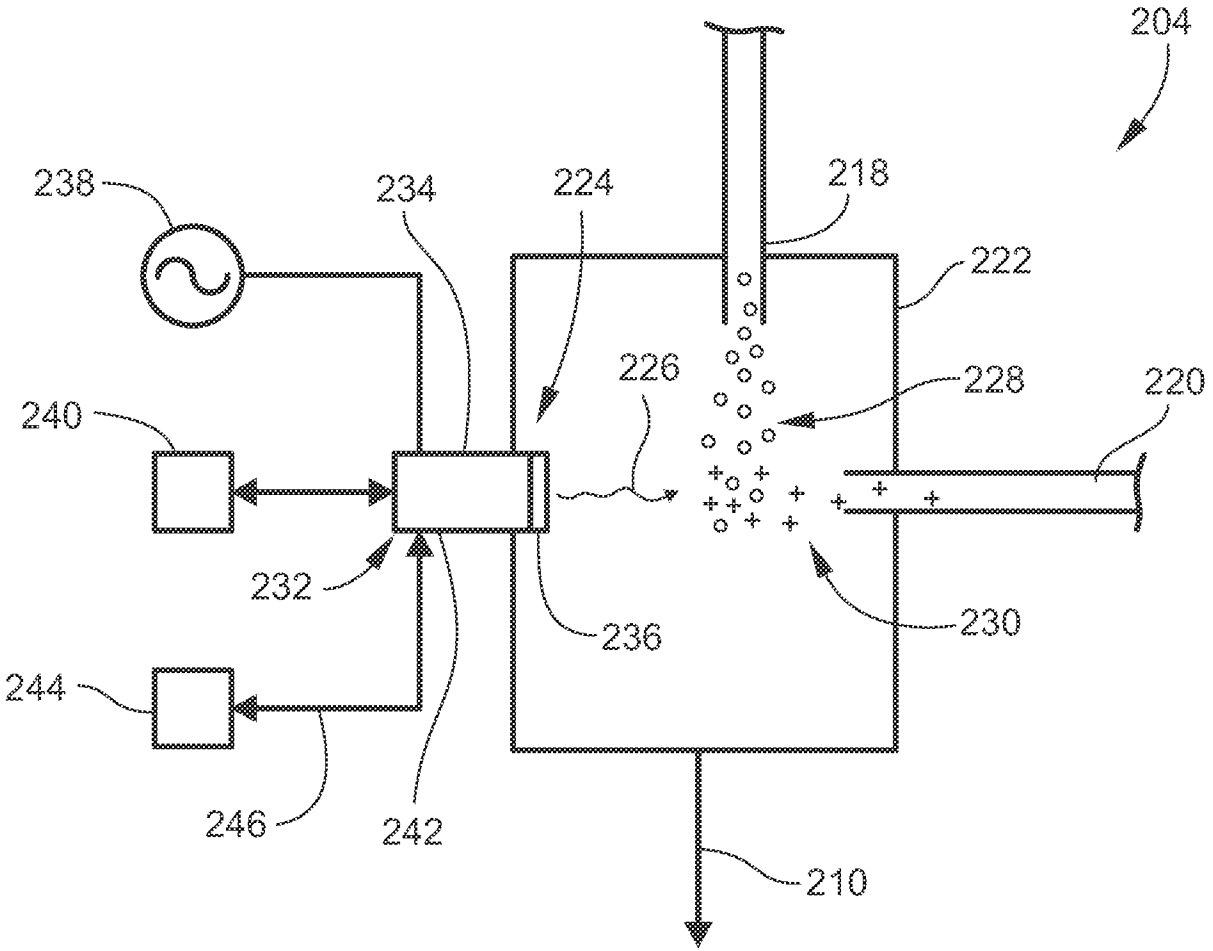
FIG. 2 is a schematic view of an example of a photo-ionization (PI) apparatus according to some embodiments.

FIG. 2 is a schematic view of an example of a PI apparatus 204 according to some embodiments. The PI apparatus 204 may include an ionization chamber 222; a sample inlet 218, an ion outlet 220 and vacuum line 210 communicating with the ionization chamber 222; and a VUV photon source 224 positioned to direct VUV photons 226 toward a sample 228 in the ionization chamber 222 to produce analyte ions 230. The VUV photon source 224 may include a body 232 that is sealed or sealable in a fluid-tight manner. The body 232 encloses an interior that may be filled with a plasma-forming gas. The body 232 may include a main portion (or dielectric portion) 234 that is composed of a dielectric material such as, for example, a glass (e.g., fused silica or quartz). The body 232 may also include a VUV window 236 attached to the main portion 234 in a fluid-tight manner. The VUV window 236 may be attached to the main portion 234 by any means resulting in a fluid-tight interface, such as by an adhesive or bond layer. A non-limiting example of an adhesive or bond layer is glass frit material, where bonding is activated by an appropriate thermal treatment. The VUV window 236 may be composed of a material that transmits VUV photons with high efficiency. As an example of high efficiency transmission in the present context, the VUV window 236 may transmit 80% or greater of VUV photons incident on its inside surface. The VUV window 236 may, for example, be composed of magnesium fluoride ($MgF_2$), calcium fluoride ($CaF_2$), or lithium fluoride (LiF). The VUV window 236 may be cut along a crystallographic orientation that maximizes VUV photon transmission through its lattice and/or aids in matching the thermal expansion coefficient of the window 236 to that of the body 232 particularly during the high-temperature process of bonding the window 236 to the body 232, for example C-cut (cut along the c-plane) $MgF_2$. In some embodiments, the pressure in the body 232 is about atmospheric pressure. In some embodiments, the gas pressure in the body 232 ranges from 200 to 1500 Torr. The VUV photon source 224 may also include electrodes (not shown) disposed on the body 232, examples of which are described below, for applying an electrical field in which the plasma-forming gas is immersed.

The PI apparatus 204 may also include an electrical power source 238 communicating with the electrodes of the VUV photon source 224. The power source 238 may include a voltage source configured for applying a voltage to the electrodes suitable for generating plasma from the gas in the interior of the VUV photon source 224 and maintaining the plasma in a stable manner for any desired period of time. In embodiments described herein, the voltage source is configured for applying a periodic (time-varying) voltage, which may be a sinusoidal voltage such as an alternating current (AC) voltage, or may have another type of periodic characteristic such as square wave, sawtooth, etc. A periodic voltage potential is applied between at least one electrode serving as a high-voltage electrode, and at least one other electrode spaced from the first electrode by a gap and either biased to a non-zero voltage or grounded. One or more dielectric barriers are positioned in the gap between the two electrodes. A part of the body 232 of the VUV photon source 224 may, for example, serve as the dielectric barrier. The VUV photon source 224 may be considered as a dielectric barrier discharge (DBD) excimer lamp. Application of the periodic voltage at an appropriate magnitude and frequency generates a DBD in the gap, which in turn generates plasma from the gas exposed to the DBD. The plasma is of the type that includes excimers (excited dimers) whose formation is induced by the DBD. The excimers upon relaxation (return to ground state) emit VUV photons.

It will be noted that the plasma itself remains sealed within the body 232 of the VUV photon source 224. Only the VUV photons 226 that pass through the VUV window 236 enter the ionization chamber 222 to interact with the sample 228. Other energetic components of the plasma (ions, electrons, metastables, etc.) remain confined within the sealed body 232.

The plasma-forming gas may be any gas or combination of gases from which an intense, non-coherent DBD plasma containing VUV photon-emitting excimers may be generated. The plasma-forming gas may also be characterized as having a composition that includes excimer precursors. Examples of the plasma-forming gas species suitable for forming VUV photon-emitting excimers in response to excitation by a DBD include, but are not limited to, a noble gas (argon, xenon, krypton, neon, and helium), a combination or two or more noble gases, and a combination of one or more noble gases and a non-noble gas such as hydrogen. In addition, certain noble gas halides are capable of forming excimers (or "exciplexes") that emit photons in the VUV range, for example argon fluoride (ArF*, about 193 nm). In some embodiments, the VUV photon source 224 may provide high conversion efficiency (e.g., 40% or greater) of electrical energy to VUV photon flux. Prototypes of the VUV photon source 224 utilizing argon have been found to provide a flux level of at least ten times greater than that of a standard krypton gas discharge lamp of similar size. In addition, minimal photon absorption occurs in a DBD due to electrical excitation of the argon neutrals to excimers via a three-body process and decay (radiation) to a non-absorbing ground state. In addition, as demonstrated below by detailed representative embodiments of the VUV photon source 224, the electrodes utilized for generating the DBD may be positioned outside of the gas-filled interior. By such configuration, the electrodes are not exposed to the high-frequency, short-lived filamentary micro-discharges characterizing the DBD, thereby avoiding loss of electrode material and contamination of the gas due to plasma-induced metal sputtering. Moreover, the use of argon (10 eV) has been found to be near optimal in terms of maximizing analyte ionization and avoiding solvent ionization. However, the other gases and combinations of gases noted above may be suitable for the ionization process in many applications.

The parameters of the periodic voltage effective for generating the DBD plasma and concomitant VUV photon-emitting excimers may depend on factors such as the type of plasma-forming gas utilized and the gas pressure in the VUV photon source 224. In some embodiments, the periodic voltage has a magnitude on the order of kilovolts (kV) and a frequency on the order of hertz (Hz) or kilohertz (kHz). In some embodiments, the periodic voltage has a magnitude ranging from 3 kV to 60 kV peak-to-peak and a frequency ranging from 50 Hz to 300 kHz.

The PI apparatus 204 may also include a cooling device or system 240 configured for cooling the high-voltage electrode and optionally other components of the VUV photon source 224 during operation. In some embodiments the cooling device or system 240 may be configured for circulating a suitable heat transfer medium (or coolant) into thermal contact with the high-voltage electrode and other components. For this purpose, the cooling device or system 240 may include one or more fluid reservoirs, pumps or other fluid moving devices, conduits, heat exchangers, and the like as appreciated by persons skilled in the art. The heat transfer medium may be a gas (e.g., air) or a liquid (e.g., water). The thermal contact made between the heat transfer medium and the high-voltage electrode may be direct contact or indirect contact. That is, the term "thermal contact" generally refers to routing the heat transfer medium into close enough proximity to the high-voltage electrode to remove heat at a rate and quantity sufficient for maintaining consistent, failure-free operation of the VUV photon source 224. Alternatively or additionally, a passive cooling system not requiring the movement of a fluid may be utilized. For example, heat may be conducted away from the high-voltage electrode using a high thermal conductivity rod or tube, for example aluminum nitride, which may also function as an electrical insulator for the high-voltage electrode.

The VUV photon source 224 may include one or more gas ports 242 formed through the body 232 between the interior and the ambient outside the body 232. The gas port(s) 242 may be sealed in a fluid-tight manner by any suitable sealing component (e.g., plug) and technique to fluidly isolate the interior from the ambient and prevent gas leakage. In some embodiments, the gas port 242 may be sealed in a permanent manner. In this case, as part of the fabrication process, the body 232 may be cleaned, evacuated, and charged with a desired type of plasma-forming gas via the gas port 242, and then the gas port 242 is sealed and remains so for the operational life of the VUV photon source 224. In other embodiments, the gas port 242 may be re-sealable. That is, the sealing component may be removable and either reusable or replaceable with a new sealing component. In this case, the sealing component may be removed to purge the interior, after which the VUV photon source 224 may be re-charged with the same gas but to a different pressure level, or charged with a different gas or mixture of gases.

In other embodiments, the PI apparatus 204 may also include a gas transport system (or gas handling system) 244 that communicates with one or more gas ports 242 in a fluid-tight manner via one or more gas lines 246 (e.g., conduits, tubing, etc.). The gas transport system 244 may be configured for alternately filling and purging the VUV photon source 224, or for circulating a plasma-forming gas through the VUV photon source 224 (for example, by utilizing two or more gas ports 242 and respective gas lines 246). Circulating the gas may be useful, for example, for removing from the photon source's interior residual contaminants or contaminants outgassing from the photon source's materials, or for removing heat from the lamp during operation. For these purposes, the gas transport system 244 may include one or more gas reservoirs, pumps or other fluid moving devices, conduits, flow controllers, pressure transducers and the like as appreciated by persons skilled in the art. The gas transport system 244 may, for example, be configured for enabling selection of different types of gases and gas mixtures for use as the plasma-forming gas in the VUV photon source 224. The gas transport system 244 may be fluidly isolated from the ambient such that when it is in open communication with the body's interior the VUV photon source 224 remains fluidly isolated from the ambient. The gas transport system 244 may include an ON/OFF valve in the gas line 246 that is closed when the gas transport system 244 is not in use.

As illustrated in FIG. 2, in some embodiments the VUV photon source 224 may extend partially into the ionization chamber 222, such as through a vacuum-tight feed-through structure in a wall of the ionization chamber 222, so that at least the VUV window 236 is disposed in the ionization chamber. Thus, in low-pressure ionization implementations, a portion of the VUV photon source 224 including the VUV window 236 is exposed to vacuum and the remaining portion is exposed to atmospheric pressure. It will be understood that the respective orientations of the sample inlet 218, ion outlet 220 and VUV photon source 224 are illustrated in FIG. 2 by example only, and that many other orientations are possible.

Figure 3A:
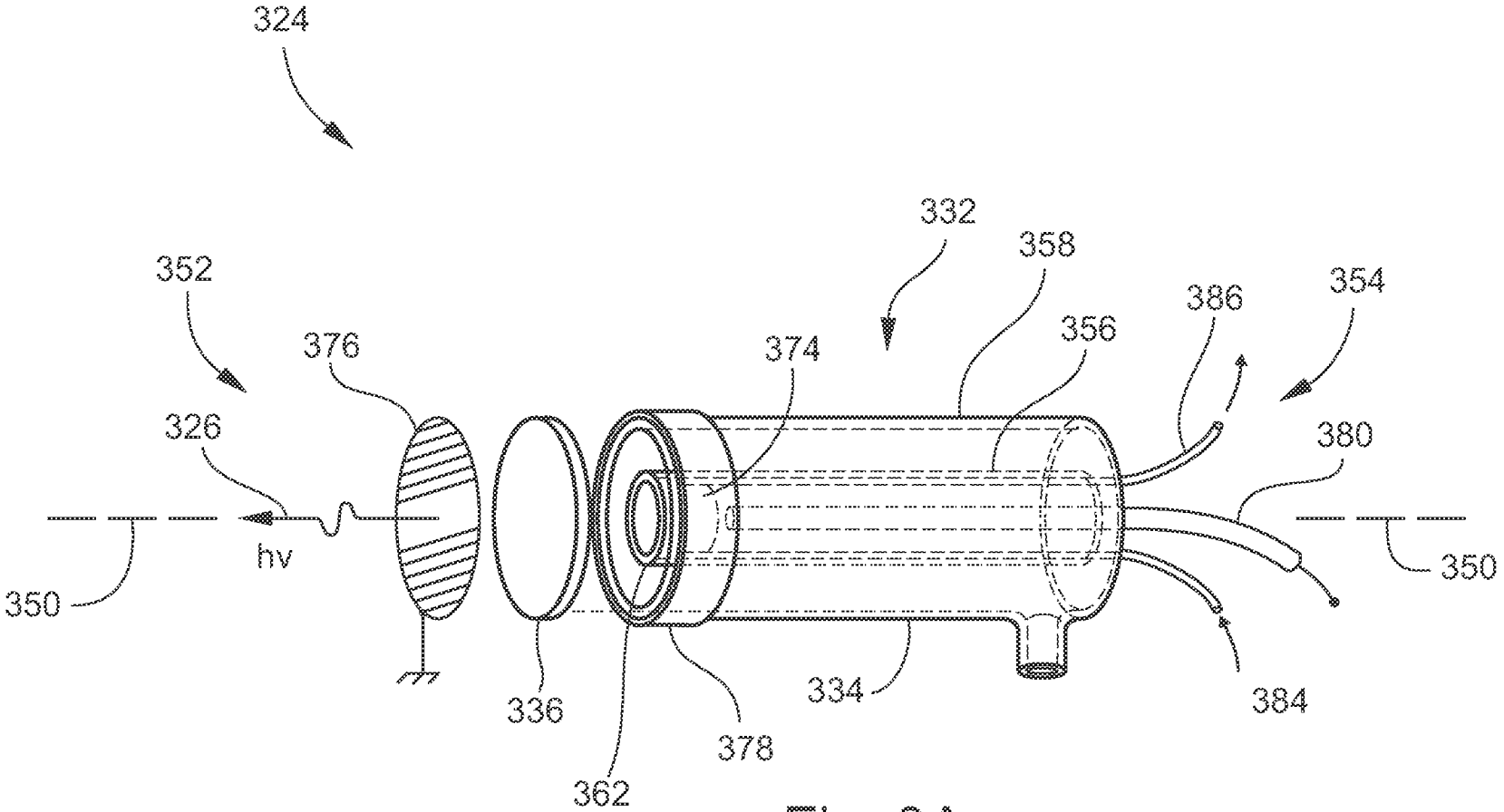
FIG. 3A is a perspective view of an example of a vacuum ultraviolet (VUV) photon source according to one embodiment.
Figure 3B:
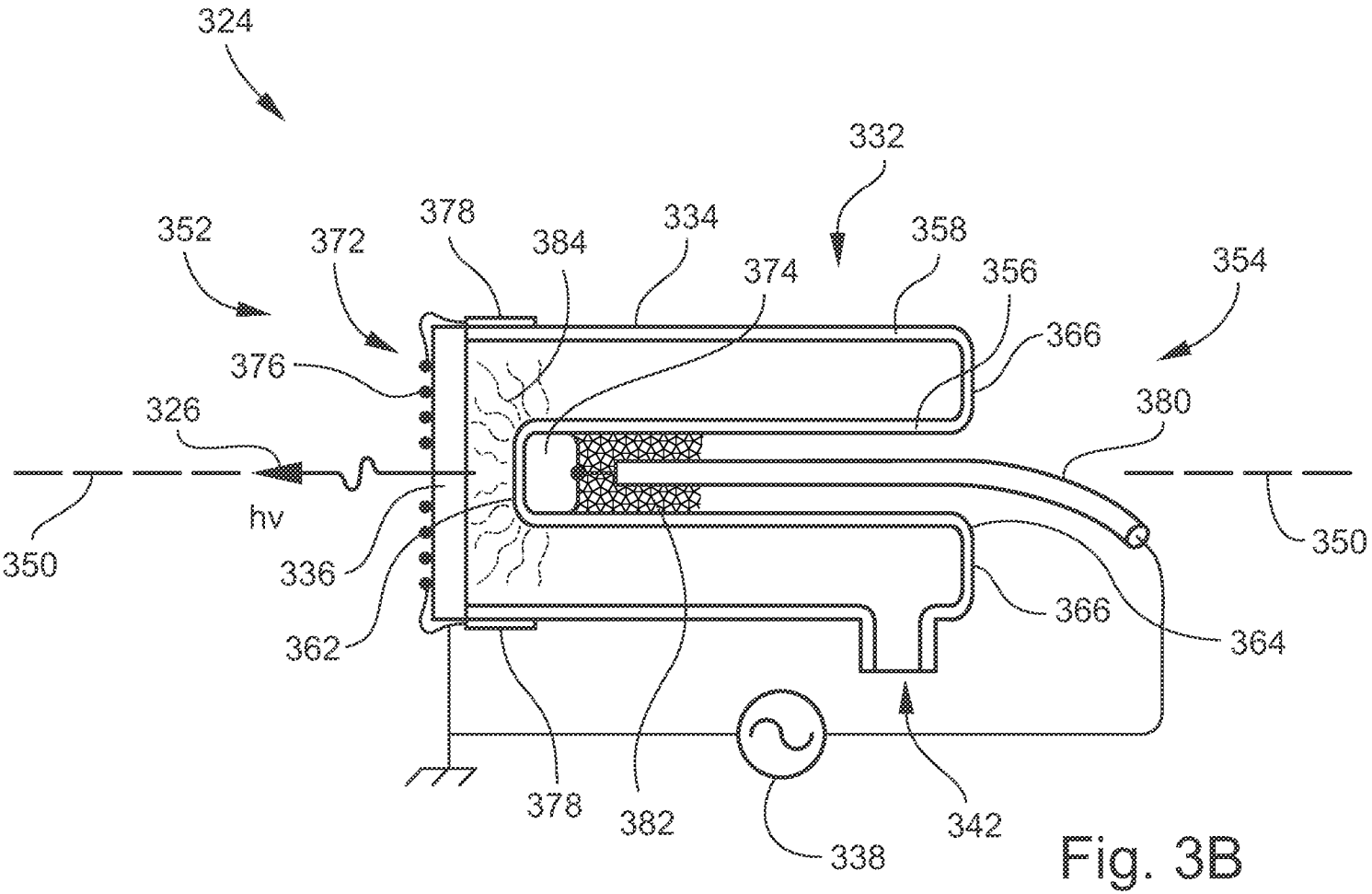
FIG. 3B is a cross-sectional side view of the VUV photon source illustrated in FIG. 3A.

FIG. 3A is a perspective view and FIG. 3B is a cross-sectional side view of an example of a VUV photon source 324 according to one embodiment. The VUV photon source 324 includes a body 332 that includes a main portion 334 and a VUV window 336. The main portion 334 is composed of a dielectric material and the VUV window 336 is composed of a VUV-transmitting material, as described above. At least a portion of the body 332 is shaped as a hollow cylinder to define an interior that in practice is filled with a plasma-forming gas. The main portion 334 extends along a longitudinal axis 350 between a first end 352 and a second end 354. In the present embodiment, the VUV window 336 is disk-shaped and oriented perpendicularly to the longitudinal axis 350. The VUV window 336 is attached to the main portion 334 at the first end 352, and may be considered as defining or forming a part of the first end 352.

Also in the present embodiment the main portion 334 includes an inner section 356 and an outer section 358, both of which may be cylindrical. The inner section 356 coaxially surrounds the longitudinal axis 350 and the outer section 358 coaxially surrounds the inner section 356, thereby forming an axially elongated interior having an annular cross-section (i.e., an annular interior space). The outer section 358 extends between the first end 352 and the second end 354. The inner section 356 includes a closed first end 362 and an open second end 364, such that the inner section 356 surrounds a cylindrical space that is outside the interior. The first end 362 of the inner section 356 is axially spaced from the VUV window 336, thereby defining a cylindrical interior space adjacent to the annular interior space. The second end 364 of the inner section 356 may be axially coextensive with the second end 354 of the outer section 358, with an annular wall 366 of the body 332 adjoining the inner section 356 and outer section 358 at this location. The annular wall 366 may be part of the inner section 356, part of the outer section 358, or a separate part. The VUV window 336 may be hermetically sealed to the main portion 334, and separate parts of the main portion 334 may be hermetically sealed together, using glass frit material. One or more gas ports 342 may be formed through the thickness of the outer section 358, and may be sealable as described above.

The VUV photon source 324 also includes a first electrode 372 and a second electrode 374, both of which may be disposed on locations of the body 332 outside the interior and thus isolated from the electrical discharges and energetic plasma components generated in the interior. The first electrode 372 and second electrode 374 may be composed of any highly electrically conductive materials suitable for the voltages contemplated, such as various metals and metal alloys (e.g., brass, copper, oxygen-free copper, etc.). Generally, the first electrode 372 and second electrode 374 are separated (spaced from each other) by a gap in the interior, and at least one solid dielectric barrier is positioned between the first electrode 372 and second electrode 374. In the present embodiment, the first electrode 372 includes an axial electrode section 376 disposed on the VUV window 336 and a radial electrode section 378 disposed on the outer section 358. The second electrode 374 is disposed on the first end 362 of the inner section 356 in the cylindrical space surrounded by the inner section 356. The axial electrode section 376 and the second electrode 374 are spaced from each other along the longitudinal axis 350. Thus, the VUV window 336 and the inner section 356 serve as dielectric barriers between the axial electrode section 376 and the second electrode 374. The radial electrode section 378 and the second electrode 374 are spaced from each other along a direction radial to the longitudinal axis 350. Thus, the inner section 356 and outer section 358 serve as dielectric barriers between the radial electrode section 378 and the second electrode 374.

The first electrode 372 may be grounded or biased to a non-zero voltage, and the second electrode 374 may serve as the high-voltage electrode. As schematically shown, an insulated high-voltage lead wire 380 runs through the cylindrical space surrounded by the inner section 356 to place the second electrode 374 in signal communication with a high-voltage power source 338. A portion of the cylindrical space occupied by the second electrode 374 and its connection with the lead wire 380 may be filled with an electrical insulator 382 such as a high-voltage potting compound to prevent unwanted discharges from the second electrode 374. One or more conduits 384 and 386 may extend into the cylindrical space for circulating a heat transfer medium. The conduits 384 and 386 may be part of a cooling system 240 (FIG. 2) as described above.

To maximize transmission of VUV photons through the VUV window, the axial electrode section 376 of the first electrode 372 may have a highly open structure. As one example, 80% or greater of the total surface area occupied by the axial electrode section 376 on the VUV window 336 may be open (i.e., devoid of electrode material). The axial electrode section 376 may, for example, be structured as a mesh or grid formed by a plurality of parallel wires running in one or more directions. The axial electrode section 376 may be fabricated by any suitable technique, and may be secured to the VUV window 336 by any suitable technique. The radial electrode section 378 may be a contiguous band or layer of metallization extending around the perimeter of the outer section 358. The axial electrode section 376 and radial electrode section 378 may or may not be electrically interconnected to each other; in either case, they are both in signal communication with the power circuitry in a configuration appropriate for generating a DBD in the photon source's interior.

In operation, a periodic voltage potential is applied between the first electrode 372 and second electrode 374, generating a DBD as schematically depicted in FIG. 3B by filamentary micro-discharges 384. The gas exposed to the DBD forms plasma containing short-lived excimers that emit VUV photons. As illustrated, the spatial orientation of the micro-discharges 384 may have axial and/or radial components, as the voltage potential is applied across both the axial gap between the axial electrode section 376 and the second electrode 374 and the radial gap between the radial electrode section 378 and the second electrode 374. Initially, the micro-discharges may occur predominantly in the axial direction. As power is increased and the dielectric material between the axial electrode section 376 and the second electrode 374 becomes saturated, micro-discharges around the corners and radial micro-discharges may occur. This may increase the formation of excimers and resulting emission of VUV photons. Ultimately, VUV photons 326 are transmitted through the VUV window 336 predominantly in the axial direction.

In other embodiments, the radial electrode section 378 may be structured as a mesh or grid and the section of the body 332 covered by the radial electrode section 378 may be composed of a VUV-transmitting material. In such embodiments, VUV photons may be emitted from the VUV photon source 324 in radial directions as well as axial directions.

Figure 4:
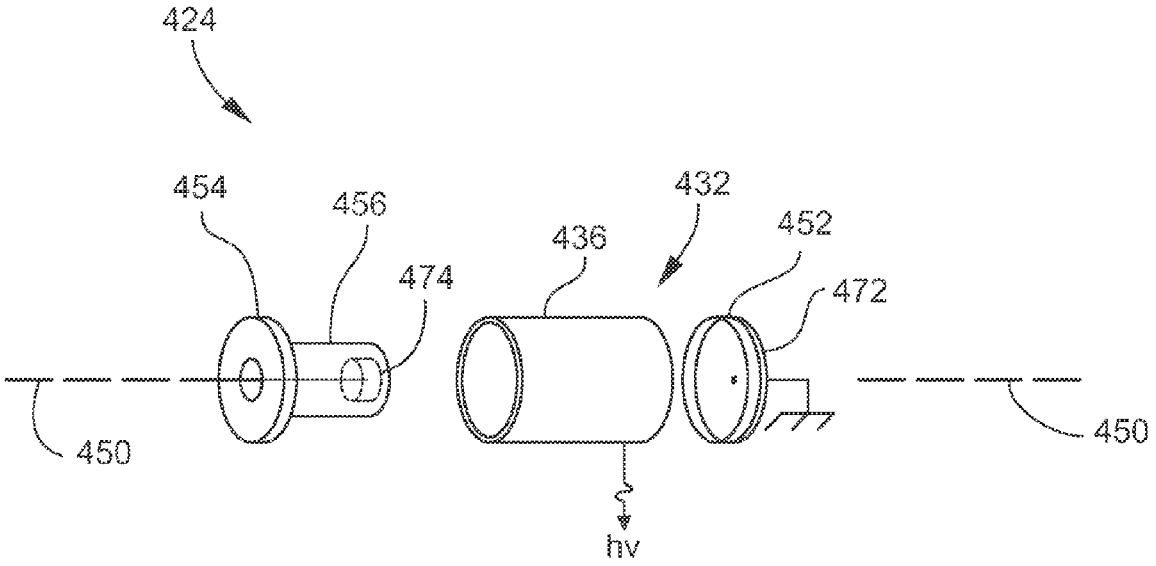
FIG. 4 is a perspective view of an example of a VUV photon source according to another embodiment.

FIG. 4 is a perspective view of an example of a VUV photon source 424 according to another embodiment. The VUV photon source includes a body 432 that includes a first end 452, a second end 454, an inner section 456, a VUV window 436, and one or more sealable gas ports (not shown). The body 432 may be generally similar to that described above and illustrated in FIGS. 3A and 3B, except that the VUV window 436 is an outer cylindrical section coaxially surrounding the inner section 456 and extending along a longitudinal axis 450 between the first end and 452 and the second end 454. The other body components may be composed of a glass or other dielectric material. The VUV photon source 424 also includes a first electrode 472 and a second electrode 474 (high-voltage electrode) disposed on locations of the body 432 outside the interior. The first electrode 472 is disposed on the first end 452, and the second electrode 474 is disposed on the inner section 456 in the cylindrical space surrounded by the inner section 456. Thus, the first electrode 472 and second electrode 474 are separated by an axial gap in the interior. The first end 452 of the body 432 and the end of the inner section 456 on which the second electrode 474 is disposed serve as dielectric barriers between the first electrode 472 and the second electrode 474.

The VUV photon source 424 may include power circuitry and provisions for cooling as generally described above and illustrated in FIGS. 3A and 3B. The operation of the VUV photon source 424 may be generally similar to that described above and illustrated in FIGS. 3A and 3B. In the present embodiment, however, the micro-discharges of the DBD have a predominantly axial orientation (between the axially spaced first electrode 472 and second electrode 474), and the VUV photons are transmitted through the VUV window 436 predominantly in radial directions.

Figure 5:
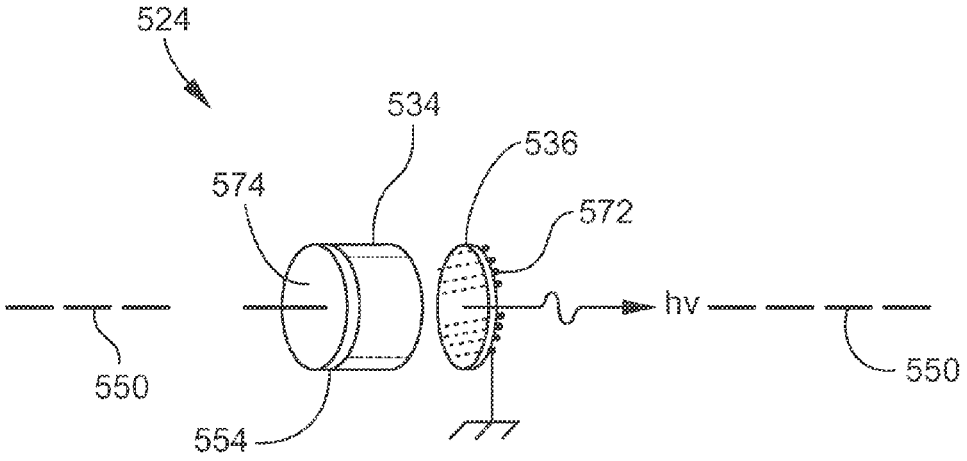
FIG. 5 is a perspective view of an example of a VUV photon source according to another embodiment.

FIG. 5 is a perspective view of an example of a VUV photon source 524 according to another embodiment. The VUV photon source 524 includes a body 532 that includes a first end at which a VUV window 536 is located, a second end 554, a main portion 534 extending along a longitudinal axis 550 between the VUV window 536 and the second end 554, and one or more sealable gas ports (not shown). The body 532 may be generally similar to that described above and illustrated in FIGS. 3A and 3B, except that the main portion 554 includes one cylindrical section with no inner section. Excepting the VUV window 536, the body components may be composed of a glass or other dielectric material. The VUV photon source 524 also includes a first electrode 572 and a second electrode 574 (high-voltage electrode) disposed on locations of the body 532 outside the interior. The first electrode 572 is disposed on the VUV window 536 and may be a mesh or grid as described above, and the second electrode 574 is disposed on the second end 554. Thus, the first electrode 572 and second electrode 574 are separated by an axial gap in the interior. The VUV window 536 and the second end 554 serve as dielectric barriers between the first electrode 572 and the second electrode 574.

The VUV photon source 524 may include power circuitry and provisions for cooling as generally described above and illustrated in FIGS. 3A and 3B. The operation of the VUV photon source 524 may be generally similar to that described above and illustrated in FIGS. 3A and 3B. In the present embodiment, however, the micro-discharges of the DBD have a predominantly axial orientation as in the embodiment illustrated in FIG. 4. The VUV photons are transmitted through the VUV window 536 predominantly in the axial direction as in the embodiment illustrated in FIGS. 3A and 3B.

In some embodiments, the VUV photon sources such as illustrated in FIGS. 2-5 may include one or more mirrors in the body interior configured for reflecting VUV photons, which may increase the amount of VUV photons transmitted through the VUV window. A mirror may be an inside surface of the body's structure or the surface of a component located in the body's interior. Reflection of photons may be an inherent property of the inside surface, or the result of a surface treatment or a coating or layer applied to the inside surface such as a reflective metal surface.

In some embodiments, the VUV photon sources such as illustrated in FIGS. 2-5 may include a getter located in the interior space, such as a coating of appropriate composition located at one or more regions of the inside surface of the dielectric structure. The getter may be utilized for scavenging undesired components (e.g., water vapor, carbon dioxide, etc.), and/or for providing a reservoir of the plasma-forming gas via reversible adsorption.

FIGS. 2-5 illustrate VUV photon sources having cylindrical geometries. It will be understood that a cylindrical geometry is but one example. More generally, the VUV photon sources disclosed herein may have any geometry suitable for generating and emitting VUV photons toward a desired target such as, for example, a sample to be photo-ionized.

Figure 6:
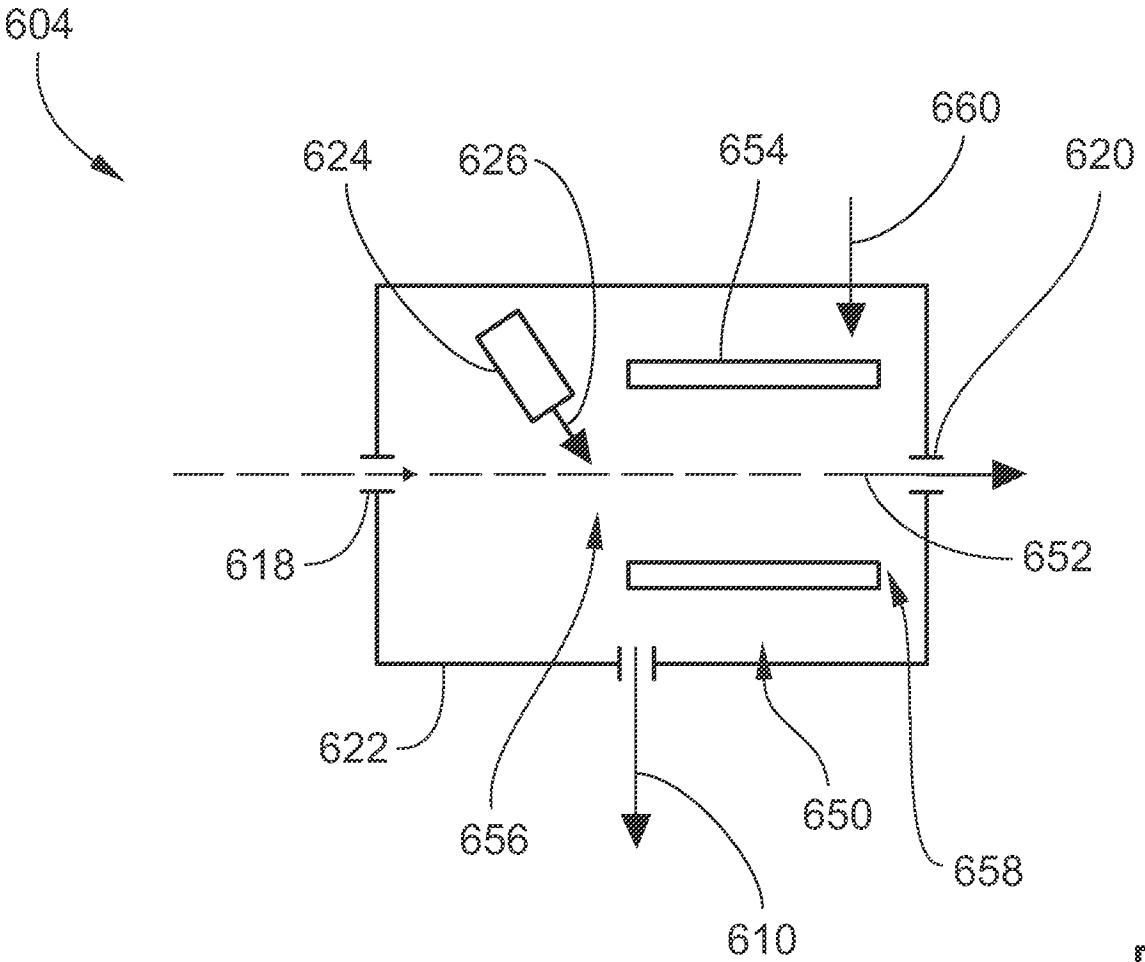
FIG. 6 is a schematic view of an example of a PI apparatus according to other embodiments.

FIG. 6 is a schematic view of an example of a PI apparatus 604 according to other embodiments. The PI apparatus 604 may include an ionization chamber 622; a sample inlet 618, ion outlet 620 and vacuum line 610 communicating with the ionization chamber 622; and a VUV photon source 624 positioned to direct VUV photons 626 toward a sample in the ionization chamber 622 to produce analyte ions. As illustrated, the body of the VUV photon source 624 may be disposed completely within the ionization chamber 622. It will be understood that FIG. 6 is merely illustrative of one example of possible positions of the sample inlet 618 and VUV photon source 624, and that other positions are possible. For example, the respective positions of the sample inlet 618 and VUV photon source 624 may be reversed to prevent a direct line-of-sight path between the sample inlet 618 and ion outlet 620, thus preventing un-ionized particles or neutrals from entering the MS and causing chemical noise. The PI apparatus 604 may further include an ion guide 650 positioned generally between the sample inlet 618 and the ion outlet 620.

Generally, the ion guide 650 may have any configuration effective for collecting a large amount of analyte ions from the ionization region with high (up to 100%) efficiency, compressing or focusing ions into a narrow beam along an ion guide axis 652, and transferring the ions into the MS with high (up to 100%) efficiency, i.e., with minimal ion loss and minimal inclusion of non-analyte species. The ion guide 650 may generally include a set of ion guide electrodes 654 arranged about the ion guide axis 652 and surrounding an interior of the ion guide 650, an ion guide entrance 656 leading into the interior, and an ion guide exit 658 leading out from the interior. The VUV photon source 624 (or at least the VUV window 626) may be positioned upstream of the ion guide entrance 656, at the ion guide entrance 656, or inside the ion guide 650.

The PI apparatus 604 may also include a damping gas (or collision gas) source 660. The damping gas may be an inert gas (e.g., helium, nitrogen, argon, etc.) that reduces the kinetic energy of analyte ions ("thermalizes" or "cools" the ions) in the ion guide 650 by collisions, under conditions (pressure, ion energies) that do not induce ion fragmentation or dissociation. The damping gas may be useful for slowing down neutral analyte molecules to increase the window of time available for their ionization, assisting in producing a compressed ion beam in the ion guide 650, and/or reducing the energy spread of the ions. The ion guide electrodes 654 may be arranged in an "open" configuration that provides multiple pathways for neutral gas/vapor species from the sample inlet to flow toward a vacuum line 610, and for damping gas to flow through the ion guide 650 and toward the vacuum line 610. The ion guide 650 may thus serve as a filter for material that does not contribute to the MS signal.

The ion guide electrodes 654 may be in signal communication with one or more radio frequency (RF) voltage sources and direct current (DC) sources (not shown). An RF voltage or composite RF/DC voltage is applied to at least some of the ion guide electrodes 654 at an RF voltage drive frequency and magnitude suitable for generating a periodic, two-dimensional RF confining field that repels ions of a desired m/z range (i.e., analyte ions) away from the ion guide electrodes 654, in a manner analogous to the RF trapping field applied by a linear ion trap. Hence, the RF confining field constrains the radial component of ion motion whereby the ions are focused in an ion cloud or beam along the ion guide axis 652. The damping gas (when employed) may assist in focusing the ions. The selection of the RF voltage drive frequency and magnitude will depend on factors such as the m/z range to be stably focused and transmitted. In some embodiments, the RF voltage drive frequency ranges from 10 kHz to 10 MHz and the voltage magnitude ranges from 10 V to 1000 V peak-to-peak.

Separately, in some embodiments a DC voltage is applied to one or more of the ion guide electrodes 654, and/or to additional ion optics components near the ion guide entrance 656 and ion guide exit 658, so as to generate an axial DC voltage gradient (and resulting accelerating field) sufficient to promote motion of the ions toward the ion guide exit 658 The DC voltage may be useful for preventing ion stalling that may result from the use of damping gas, and/or preventing ion stalling or reflection (back toward the ion guide entrance 656) that may result from the RF confining field at a small ion guide exit 658. In some embodiments, the ion guide 650 transmits ions to the MS efficiently without the use of either a flow of damping gas or an axial DC field.

In some embodiments, the ion guide electrodes 654 have a multipole configuration in which each ion guide electrode 654 is elongated generally in a direction from the ion guide entrance 656 to the ion guide exit 658. The ion guide electrodes 654 may be parallel with each other and circumferentially spaced from each other about the ion guide axis 652. The electrode set may be a quadrupole arrangement (two opposing pairs of electrodes) or a higher-order multipole arrangement with additional opposing pairs of electrodes (e.g., hexapole, octopole, etc.). For clarity, only one opposing pair of ion guide electrodes 654 is shown in FIG. 6. In typical implementations, the RF confining field is produced by applying RF voltages to each ion guide electrode 654 such that the RF voltage on any given ion guide electrode 654 is 180 degrees out of the phase with the RF voltage on the adjacent ion guide electrode(s) 654. DC voltages may be applied to some or all of the ion guide electrodes 654 and/or to entrance and exit lenses as needed to control the axial motion of the ions.

In some embodiments, the ion guide electrodes 654 are configured to compress the ion beam such that the ion beam has a converging profile, i.e., the cross-sectional area of the ion beam (in the plane perpendicular to the ion guide axis) converges (reduces) in the direction of the ion guide exit 658. By such configuration, the ion beam acceptance is defined by the ion guide entrance 656 and a final ion beam emittance smaller than the beam acceptance is defined by the ion guide exit 658 (or by a conductance-limiting aperture adjacent to the ion guide exit 658). In some embodiments, the converging ion beam is realized by the ion guide electrodes 654 likewise having a converging profile such that the cross-sectional area of the ion guide exit 658 is less than the cross-sectional area of the ion guide entrance 654. Examples of the foregoing include electrode configurations termed "ion funnels" as appreciated by persons skilled in the art.

Figure 7:
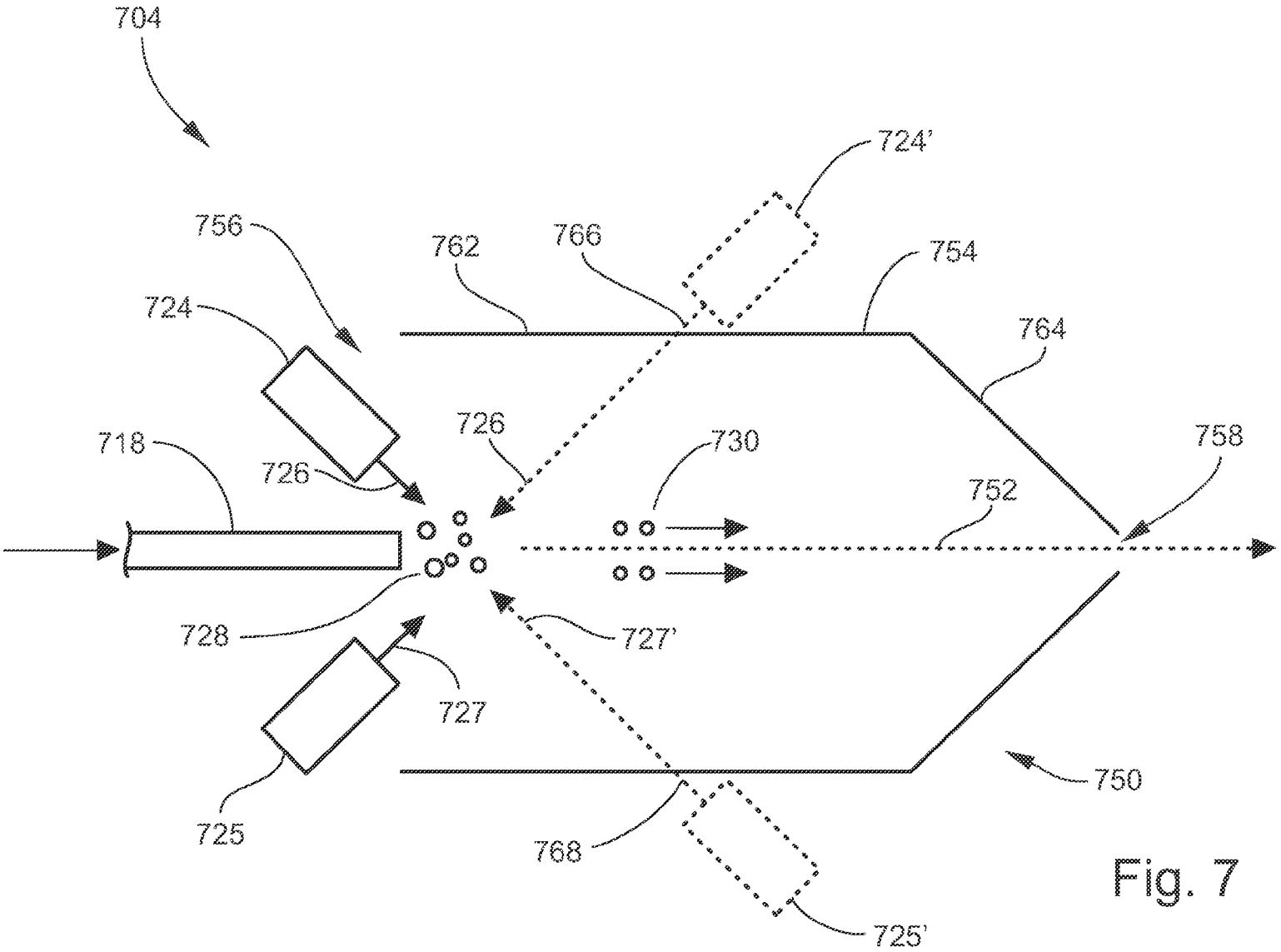
FIG. 7 is a schematic view of an example of a PI apparatus according to other embodiments.

FIG. 7 is a schematic view of an example of a PI apparatus 704 according to other embodiments. The PI apparatus 704 may include an ionization chamber (the outer structure of which is not shown); a sample inlet 718, ion outlet (not shown) and vacuum line (not shown) communicating with the ionization chamber; one or more ionization devices (e.g., a first ionization device 724 and a second ionization device 725) positioned to direct energy (depicted by example as respective beams 726 and 727) toward a sample 728 in the ionization chamber to produce analyte ions 730; and an ion guide 750 positioned generally between the sample inlet 718 and the ion outlet. One or more of the ionization devices 724 and 725 may be a VUV photon source as described herein. One or more of the ionization devices 724 and 725 may be a different type of ionization device such as, for example, an electron ionization (EI) device, a chemical ionization (CI) device, a field ionization (FI) device, a laser desorption ionization (LDI) device, a matrix-assisted laser desorption ionization (MALDI) device, a corona discharge device, or an atmospheric pressure ionization (API) device.

The ion guide 750 includes a plurality of ion guide electrodes 754 arranged about an ion guide axis 752, an ion guide entrance 756, and an ion guide exit 758 axially spaced from the ion guide entrance 756. In operation, radial RF confining fields and axial DC acceleration fields may be generated as described elsewhere in this disclosure. In the present embodiment, the ion guide 750 includes a first section 762 of ion guide electrodes beginning at the ion guide entrance 756, followed by a second section 764 of ion guide electrodes terminating at the ion guide exit 758. The first section 762 may have a constant or substantially constant cross-sectional area, and in some embodiments may be a cylindrical section. The first section 762 may be useful for increasing the residence time of neutral analytes in the ion guide 750 to improve ionization yield, for enhancing removal of neutral gas/vapor species, and/or for enhancing thermalization of as-produced analyte ions 730 through increased collisions with a damping gas. The second section 764 may have a cross-sectional area that tapers (is reduced) in the direction toward the ion guide exit 758, and in some embodiments may be a conical section. The second section 764 is thus configured for producing a converged ion beam as described above. The axial lengths of the first section 762 and second section 764 may be the same or substantially the same, or may be different.

In some embodiments, the ion guide 750 may include more than one section of ion guide electrodes of constant cross-sectional area, and/or more than one section of ion guide electrodes of tapering cross-sectional area. A section of constant cross-sectional area may be interposed between two sections of tapering cross-sectional area, and/or a section of tapering cross-sectional area may be interposed between two sections of constant cross-sectional area.

In the present embodiment, the sample inlet 718 is positioned just upstream of, or at, or inside of the ion guide entrance 756, such that neutral sample components 728 are discharged from the sample inlet 718 directly into the ion guide 750 and the ionization region is located at least partially in the ion guide 750. In the present embodiment, the ionization devices 724 and 725 are positioned at or near the ion guide entrance 756, but in other embodiments may be positioned in other locations. As an example, FIG. 7 illustrates an alternative first ionization device 724' and second ionization device 725' positioned outside the ion guide 750 at intermediate points along the axial length of the ion guide 750. Respective energy beams 726' and 727' from the alternative ionization devices 724' and 725' may be transmitted through apertures 766 and 768 formed through certain ion guide electrodes 754 or through spaces between adjacent ion guide electrodes 754. It will be understood that in other embodiments, a single ionization device or more than two ionization devices may be provided of the same or different type.

It will be understood that FIG. 7 schematically illustrates the outer profile or envelope of the interior region defined by the electrode set. In practice a number of ion guide electrodes 754, individually addressable by voltage sources, may be spaced from each other circumferentially about the ion guide axis 752, or axially along the ion guide axis 752. The present disclosure encompasses various embodiments in which the ion guide electrodes 754 are configured for providing a converging ion confining region as described above.

In some embodiments, the ion guide electrodes may include a series of plate-shaped electrodes arranged transversely to the ion guide axis and axially spaced from each other, with each electrode having an aperture through which the ion guide axis passes. The aperture of the first electrode at the ion guide entrance may have the largest cross-sectional area, the aperture of the last electrode at the ion guide exit may have the smallest cross-sectional area, the apertures of one or more electrodes between the first and last electrodes may have cross-sectional areas that successively reduce from the largest to the smallest cross-sectional area. Examples of this type of ion guide are disclosed in U.S. Patent App. Pub. No. 2011/0147575, the entire contents of which are incorporated herein by reference. In other embodiments, the ion guide electrodes may include a multipole arrangement similar to that described above in conjunction with FIG. 6, but with the electrodes oriented so as to converge toward each other in the direction of the ion guide exit i.e., at an angle to the ion guide axis, such that the cross-sectional area of the interior region at the ion guide entrance is greater than the cross-sectional area at the ion guide exit. Examples of this type of ion guide are disclosed in U.S. Pat. No. 8,193,489, the entire contents of which are incorporated herein by reference. In other embodiments, the ion guide electrodes may include a multipole arrangement of generally parallel electrodes, but the diameters of the electrodes are varied along the axial direction such that the cross-sectional area of the interior region at the ion guide entrance is greater than the cross-sectional area at the ion guide exit. Examples of this type of ion guide are disclosed in U.S. Pat. No. 8,124,930, the entire contents of which are incorporated herein by reference. In other embodiments, the ion guide electrodes may include a longitudinal or transverse "RF carpet" arrangement with converging geometry, examples of which are disclosed in U.S. patent application Ser. No. 13/345,392, titled "RADIO FREQUENCY (RF) ION GUIDE FOR IMPROVED PERFORMANCE IN MASS SPECTROMETERS", the entire contents of which are incorporated herein by reference.

In other embodiments, the ion guide electrodes may generally have a parallel, elongated multipole configuration as schematically shown, for example, in FIG. 6. In this case, a converging ion confining region may be generated by varying the RF confining field such that it has a predominant higher-order multipole field component (e.g., a hexapole component) at the ion guide entrance and a predominant lower-order multipole field component (e.g., a quadrupole component) at the ion guide exit. This may be accomplished by applying appropriate RF voltages to the ion guide electrodes, which in some embodiments may be axially segmented to facilitate varying the RF confining field for this purpose. A fuller description of this approach and additional examples of electrode arrangements are provided in U.S. Pat. No. 8,124,930, the entire contents of which are incorporated herein by reference.

EXEMPLARY EMBODIMENTS

Exemplary embodiments provided in accordance with the presently disclosed subject matter include, but are not limited to, the following:

1. A vacuum ultraviolet (VUV) photon source, comprising: a body enclosing an interior and comprising a VUV window; a first electrode disposed on the body outside the interior; a dielectric barrier; and a second electrode disposed on the dielectric barrier outside the interior, and separated from the first electrode by a gap in the interior, wherein the dielectric barrier is disposed between the first electrode and the second electrode.

2. The VUV photon source of embodiment 1, comprising a driver in signal communication with the second electrode and configured for applying a periodic voltage having a magnitude ranging from 3 kV to 60 kV peak-to-peak and a frequency ranging from 50 Hz to 300 kHz.

3. The VUV photon source of embodiment 1 or 2, comprising a driver in signal communication with the second electrode and configured for applying a periodic voltage having a magnitude and a frequency effective for generating a dielectric barrier discharge plasma from a gas in the gap, wherein the gas is selected from the group consisting of a noble gas, a combination of two or more noble gases, and a combination of a non-noble gas and one or more noble gases.

4. The VUV photon source of any of embodiments 1-3, comprising a driver in signal communication with the second electrode and configured for applying a periodic voltage having a magnitude and a frequency effective for generating dielectric barrier discharge-induced excimers in the gap that emit photons in the VUV range.

5. The VUV photon source of any of embodiments 1-4, wherein the body contains a gas in the gap selected from the group consisting of a noble gas, a combination of two or more noble gases, and a combination of a non-noble gas and one or more noble gases.

6. The VUV photon source of any of embodiments 1-5, wherein the body comprises a gas port communicating with the interior and configured for fluidly isolating the interior from an environment outside the VUV photon source.

7. The VUV photon source of embodiment 6, wherein the gas port is configured for coupling with a gas transport system fluidly isolated from the outside environment.

8. The VUV photon source of any of embodiments 1-7, wherein the VUV window has a composition selected from the group consisting of magnesium fluoride, calcium fluoride, and lithium fluoride.

9. The VUV photon source of any of embodiments 1-8, comprising a conduit positioned to transport a coolant into thermal contact with the second electrode.

10. The VUV photon source of any of embodiments 1-9, wherein the body comprises an inner section coaxially disposed about a longitudinal axis and an outer section surrounding the inner section, the interior includes an annular region between the inner section and the outer section, and the inner section comprises the dielectric barrier.

11. The VUV photon source of embodiment 10, wherein the first electrode and the second electrode are spaced from each other along the longitudinal axis.

12. The VUV photon source of embodiment 10, wherein the first electrode is disposed on the outer section, and the first electrode and the second electrode are spaced from each other along a direction radial to the longitudinal axis.

13. The VUV photon source of embodiment 10, wherein the first electrode comprises an axial electrode section and a radial electrode section, the axial electrode section and the second electrode are spaced from each other along the longitudinal axis, and the radial electrode section and the second electrode are spaced from each other along a direction radial to the longitudinal axis.

14. The VUV photon source of embodiment 10, wherein the outer section comprises the VUV window.

15. The VUV photon source of embodiment 14, wherein the first electrode and the second electrode are spaced from each other along the longitudinal axis.

16. The VUV photon source of embodiment 10, wherein the VUV window is disposed at an axial end of the outer section.

17. The VUV photon source of embodiment 16, wherein the first electrode is disposed on the outer section, and the first electrode and the second electrode are spaced from each other along a direction radial to the longitudinal axis.

18. The VUV photon source of embodiment 17, wherein the first electrode comprises an axial electrode section disposed on the VUV window and a radial electrode section disposed on the outer section.

19. The VUV photon source of any of embodiments 1-9, wherein the body comprises an axial end spaced from the dielectric barrier along a longitudinal axis.

20. The VUV photon source of embodiment 19, wherein the axial end comprises the VUV window.

21. The VUV photon source of any of embodiments 1-20, wherein the body comprises an inner surface configured for reflecting VUV photons.

22. A photo-ionization (PI) apparatus, comprising: a chamber comprising a sample inlet and an ion outlet; and the VUV photon source of any of embodiments 1-21 disposed in the chamber.

23. The PI apparatus of embodiment 22, comprising a vacuum system configured for maintaining the chamber at a pressure ranging from 0.01 to 100 Torr.

24. The PI apparatus of embodiment 22 or 23, wherein the interior of the body contains a gas at a pressure ranging from 200 to 1500 Torr 25. The PI apparatus of any of embodiments 22-24, wherein the chamber comprises a wall, the VUV photon source extends through the wall, and the second electrode is fluidly isolated from an interior of the chamber.

26. The PI apparatus of any of embodiments 22-25, comprising an ion funnel in the chamber, wherein the VUV photon source is positioned to direct VUV photons at or near an entrance of the ion funnel.

27. A mass spectrometry (MS) system, comprising: the PI apparatus of any of embodiments 22-26; and a mass analyzer communicating with the ion outlet.

28. The MS system of embodiment 27, comprising an analytical separation device communicating with the sample inlet.

29. A method for generating vacuum ultraviolet (VUV) photons, comprising: generating a dielectric barrier discharge (DBD) in an interior of a photon source by applying a periodic voltage between a first electrode and a second electrode, wherein the first electrode and the second electrode are disposed outside the interior and are separated by a dielectric barrier and a gap in the interior, and wherein the DBD produces excimers from a gas in the gap; and transmitting VUV photons emitted from the excimers through a window of the photon source.

30. The method of embodiment 29, wherein the first electrode and the second electrode are spaced from each other along a longitudinal axis, the window is coaxially disposed about the longitudinal axis, the DBD has a predominantly axial orientation, and the VUV photons are transmitted through the window predominantly in a radial direction.

31. The method of embodiment 29, wherein the first electrode and the second electrode are spaced from each other along a longitudinal axis, the first electrode is disposed on the window, the DBD has a predominantly axial orientation, and the VUV photons are transmitted through the window predominantly in an axial direction.

32. The method of embodiment 29, wherein the first electrode comprises an axial electrode section and a radial electrode section, the axial electrode section and the second electrode are spaced from each other along a longitudinal axis, the radial electrode section is coaxially disposed about the second electrode relative to the longitudinal axis, the DBD has a spatial orientation comprising axial and radial components, and the VUV photons are transmitted through the window predominantly in an axial direction.

33. A method for ionizing a sample, the method comprising: introducing the sample into a chamber; and exposing the sample to VUV photons by generating the VUV photons according to the method of any of embodiments 29-32, wherein the VUV photons are transmitted into the chamber from the window.

34. The method of embodiment 33, comprising maintaining the chamber at a pressure ranging between 0.01 and 100 Torr.

35. The method of embodiment 33 or 34, wherein exposing the sample occurs at or near an entrance of an ion funnel, and further comprising operating the ion funnel to compress ions produced by photoionization into a converging beam.

36. A method for analyzing a sample, the method comprising: ionizing the sample according to the method of any of embodiments 33-35 to produce ions; and transmitting the ions into a mass analyzer.

37. The method of embodiment 36, comprising, prior to ionizing, subjecting the sample to analytical separation, and introducing the separated sample into the chamber.

38. An analytical system, comprising:

the PT apparatus of embodiment 22; and an analytical instrument communicating with the ion outlet.

39. The system of embodiment 38, wherein the analytical instrument comprises an ion mobility spectrometer or an MS.

In the above description, an MS system is presented as an example of an operating environment for VUV photon sources disclosed herein. It will be understood, however, that the VUV photon sources are not limited to operating in conjunction with MS systems, but instead may be utilized in any application entailing the use of VUV photons.

It will be understood that the term "in signal communication" as used herein means that two or more systems, devices, components, modules, or sub-modules are capable of communicating with each other via signals that travel over some type of signal path. The signals may be communication, power, data, or energy signals, which may communicate information, power, or energy from a first system, device, component, module, or sub-module to a second system, device, component, module, or sub-module along a signal path between the first and second system, device, component, module, or sub-module. The signal paths may include physical, electrical, magnetic, electromagnetic, electrochemical, optical, wired, or wireless connections. The signal paths may also include additional systems, devices, components, modules, or sub-modules between the first and second system, device, component, module, or sub-module.

More generally, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. A vacuum ultraviolet (VUV) photon source, comprising:

a body enclosing an interior and comprising a VUV window, wherein the body is coaxially disposed about a longitudinal axis;

a first electrode disposed on the body outside the interior;

a dielectric barrier; and a second electrode disposed on the dielectric barrier outside the interior, and separated from the first electrode by a gap in the interior, wherein the first electrode and the second electrode are axially spaced from each other along the longitudinal axis, and the dielectric barrier is disposed between the first electrode and the second electrode.

2. The VUV photon source of claim 1, comprising a driver in signal communication with the second electrode and configured for applying a periodic voltage having a magnitude and a frequency effective for generating a dielectric barrier discharge plasma from a gas in the gap, wherein the gas is selected from the group consisting of a noble gas, a combination of two or more noble gases, and a combination of a non-noble gas and one or more noble gases.

3. The VUV photon source of claim 1, wherein the body comprises a gas port communicating with the interior and configured for fluidly isolating the interior from an environment outside the VUV photon source.

4. The VUV photon source of claim 1, wherein the VUV window has a composition selected from the group consisting of magnesium fluoride, calcium fluoride, and lithium fluoride.

5. The VUV photon source of claim 1, comprising a conduit positioned to transport a coolant into thermal contact with the second electrode.

6. The VUV photon source of claim 1, wherein the body comprises an inner section coaxially disposed about the longitudinal axis and an outer section surrounding the inner section, the interior includes an annular region between the inner section and the outer section, and the inner section comprises the dielectric barrier.

7. The VUV photon source of claim 6, wherein the first electrode is disposed on the outer section, and the first electrode and the second electrode are spaced from each other along a direction radial to the longitudinal axis.

8. The VUV photon source of claim 6, wherein the first electrode comprises an axial electrode section and a radial electrode section, the axial electrode section and the second electrode are spaced from each other along the longitudinal axis, and the radial electrode section and the second electrode are spaced from each other along a direction radial to the longitudinal axis.

9. The VUV photon source of claim 6, wherein the outer section comprises the VUV window.

10. The VUV photon source of claim 9, wherein the first electrode and the second electrode are spaced from each other along the longitudinal axis.

11. The VUV photon source of claim 6, wherein the VUV window is disposed at an axial end of the outer section.

12. The VUV photon source of claim 11, wherein the first electrode is disposed on the outer section, and the first electrode and the second electrode are spaced from each other along a direction radial to the longitudinal axis.

13. The VUV photon source of claim 12, wherein the first electrode comprises an axial electrode section disposed on the VUV window and a radial electrode section disposed on the outer section.

14. The VUV photon source of claim 1, wherein the body comprises an axial end spaced from the dielectric barrier along the longitudinal axis.

15. The VUV photon source of claim 14, wherein the axial end comprises the VUV window.

16. A method for generating vacuum ultraviolet (VUV) photons, comprising:

generating a dielectric barrier discharge (DBD) in an interior of a photon source by applying a periodic voltage between a first electrode and a second electrode, wherein the photon source comprises a body enclosing the interior and coaxially disposed about a longitudinal axis, and the first electrode and the second electrode are disposed outside the interior and are separated by a dielectric barrier and a gap in the interior, and the first electrode and the second electrode are axially spaced from each other along the longitudinal axis, and wherein the DBD produces excimers from a gas in the gap; and transmitting VUV photons emitted from the excimers through a window of the photon source.

17. The method of claim 16, wherein the first electrode and the second electrode are spaced from each other along the longitudinal axis, the window is coaxially disposed about the longitudinal axis, the DBD has a predominantly axial orientation, and the VUV photons are transmitted through the window predominantly in a radial direction.

18. The method of claim 16, wherein the first electrode and the second electrode are spaced from each other along the longitudinal axis, the first electrode is disposed on the window, the DBD has a predominantly axial orientation, and the VUV photons are transmitted through the window predominantly in an axial direction.

19. The method of claim 16, wherein the first electrode comprises an axial electrode section and a radial electrode section, the axial electrode section and the second electrode are spaced from each other along the longitudinal axis, the radial electrode section is coaxially disposed about the second electrode relative to the longitudinal axis, the DBD has a spatial orientation comprising axial and radial components, and the VUV photons are transmitted through the window predominantly in an axial direction.

* * * * *

UNITED STATES PATENT AND TRADEMARK OFFICE

CERTIFICATE OF CORRECTION

PATENT NO. : 9,153,427 B2
APPLICATION NO. : 13/796292
DATED : October 6, 2015
INVENTOR(S) : Noah Goldberg et al.

It is certified that error appears in the above-identified patent and that said Letters Patent is hereby corrected as shown below:

Title Page, item (56)

On the page 2, in column 2, under "Other Publications", line 4 delete "Atomospheric" and insert -- Atmospheric --, therefor.

On the page 2, in column 2, under "Other Publications", line 14 delete ""Atomonic" and insert -- Atomic --, therefor.

In the Specification

In column 9, line 67, delete "end and" and insert -- end --, therefor.

In column 16, line 39, delete "Torr" and insert -- Torr. --, therefor.

In column 17, line 39, delete "PT" and insert -- PI --, therefor.

Signed and Sealed this
Twenty-second Day of March, 2016

Michelle K. Lee

Michelle K. Lee
*Director of the United States Patent and Trademark Office*